United States Patent [19]

Bonasso et al.

[11] Patent Number: 4,571,249

[45] Date of Patent: Feb. 18, 1986

[54] APPARATUS FOR THE CONVERSION OF COAL TO GAS, LIQUID AND SOLID PRODUCTS

[75] Inventors: Jack I. Bonasso, 9 Main St., Carolina, W. Va. 26563; James T. Harper, 5940 Mallory Rd., College Park, Ga. 30349; Francis K. Verhoff, Morgantown, W. Va.

[73] Assignees: Jack I. Bonasso, Carolina, W. Va.; James T. Harper, Chamblee, Ga.

[21] Appl. No.: 523,272

[22] Filed: Aug. 15, 1983

[51] Int. Cl.[4] ..... C10J 3/58

[52] U.S. Cl. ..... 48/73; 48/63; 48/77

[58] Field of Search ..... 48/202, 206, 63, 77, 48/89, 73, 86 R; 110/269, 287; 202/99, 117; 201/34, 38, 25, 27; 518/703; 422/142, 232, 233, 216

[56] References Cited

U.S. PATENT DOCUMENTS

| | | | |
|---|---|---|---|
| 1,955,025 | 4/1934 | Sabel et al. | 202/99 |
| 2,649,468 | 8/1953 | Benedict et al. | 518/703 |
| 2,662,816 | 12/1953 | Kalbach | 48/202 |
| 3,146,175 | 8/1964 | Mansfield | 201/34 |
| 3,801,469 | 4/1974 | Essenhigh | 201/34 |

*Primary Examiner*—Jay H. Woo
*Assistant Examiner*—Joye L. Woodard
*Attorney, Agent, or Firm*—Sidney W. Millard

[57] ABSTRACT

An apparatus is provided for converting coal to gas, liquid and solid products, which comprises a single vessel including a pyrolysis chamber (20) disposed in the upper part of the vessel, and a gasification chamber (29) disposed beneath the pyrolysis chamber in the lower part of the vessel. The coal is subjected to a pyrolysis reaction at a temperature of at least about 260° C. in the presence of a hydrogen-containing gas, and the resultant solid residue subjected to a gasification reaction with oxygen and steam at a temperature of at least about 482° C. thereby generating the necessary hydrogen-containing gas for the pyrolysis reaction and producing a solid product. Heat generated during the exothermic gasification reaction is also transferred from the gasification chamber to the pyrolysis chamber for the endothermic reaction therein by conduction through a common dividing wall (74) interconnecting the two chambers. The gaseous fraction generated in the pyrolysis reaction is cooled to produce liquid and gas products, preferably after having first been subjected to a Fischer-Tropsch reaction.

8 Claims, 2 Drawing Figures

10
68
70
GASEOUS PRODUCT
66
50
54
56
52
F.T. REACTOR
F.T. REACTOR
REGENERATING GAS
46
48
42
58
CATALYST
16
41
36
40
COAL
14
12
62
LIQUID PRODUCT
38
60
26
20
PYROLYSIS REACTOR
18
28
22
24
OXYGEN
30
STEAM
32
GASIFICATION REACTOR
29
34
SOLID PRODUCT

APPARATUS FOR THE CONVERSION OF COAL TO GAS, LIQUID AND SOLID PRODUCTS

BACKGROUND OF THE INVENTION

This invention relates to a process, method and apparatus for the conversion of coal to gas, liquid and solid products. More particularly, the application relates to a method and apparatus in which coal is converted to gas, liquid and solid products by a integral combination of pyrolysis, gasification and possibly Fischer-Tropsch synthesis.

Methods and apparatus for the conversion of coal to gas, liquid and solid products (for example coal gas, coal tar and coke respectively) have been known for a long time. In the classic method for the coking of coal, coal is subjected to pyrolysis in air-tight retorts. A gaseous product is evolved which, upon cooling, yields liquids comprising coal tar and other organic chemicals, and coal gas. The solid residue left in the retort after the pyrolysis is coke. This conventional pyrolysis procedure has a number of disadvantages; the gas evolved is relatively high in carbon dioxide and low in hydrocarbons since most of the organic hydrogen in the coal ends up in the liquid stream or as molecular hydrogen in the gas, while the solid residue tends to cake and adhere to the walls of the retort. The proportion of hydrocarbon in the gas product can be improved somewhat by subjecting the gas stream to a Fischer-Tropsch reaction (the reaction of carbon monoxide and hydrogen over a catalyst, usually a metal oxide catalyst, to produce hydrocarbons and carbon dioxide), but the caking problem is sufficiently severe to prevent certain types of coal being used in such a pyrolysis reaction. In addition, such pyrolysis reactions are very energy-intensive because the coal must be maintained at a high temperature for several hours.

It is also known to subject coal, other organic materials and char derived from either coal or other organic materials to a so-called gasification reaction, in which the coal or the like is reacted with oxygen and steam to produce a gas containing hydrogen and carbon monoxide. This gasification reaction can be made to generate an amount of heat.

We have now discovered that the pyrolysis of coal can be carried out to a larger extent by conducting the pyrolysis in the presence of gas generated by subjecting the solid residue of the pyrolysis reaction to a gasification reaction.

SUMMARY OF THE INVENTION

Accordingly, this invention provides a process and apparatus for the conversion of coal to gas, liquid and solid products in which the coal is subjected to a pyrolysis reaction at a temperature of least about 260° C. in the presence of a hydrogen-containing gas, thereby forming a high temperature gaseous fraction and a solid residue. The gaseous fraction thus generated is cooled, thereby producing from the gaseous fraction a gaseous product and a liquid product. The solid residue from the pyrolysis reaction is subjected to a gasification reaction with oxygen and steam at a temperature of at least about 482° C., thereby generating hydrogen-containing gas and a solid product, and the hydrogen-containing gas thus generated in the gasification reaction is recycled to the pyrolysis reaction.

This invention also provides apparatus for the conversion of coal to gas, liquid and solid products, this apparatus comprising a pyrolysis reaction having an inlet for coal and an outlet for gas, a gasification reactor having an inlet for oxygen and steam and an outlet for a solid product, and conduit means interconnecting the pyrolysis reactor and the gasification reactor, this conduit means being arranged to permit solid residue generated in the pyrolysis reactor to pass to the gasification reactor and permitting gas generated in the gasification reactor to pass to the pyrolysis reactor, and providing cooling means for cooling gas leaving the gas outlet of the pyrolysis reactor.

DETAILED DESCRIPTION OF THE INVENTION

Figure 1:
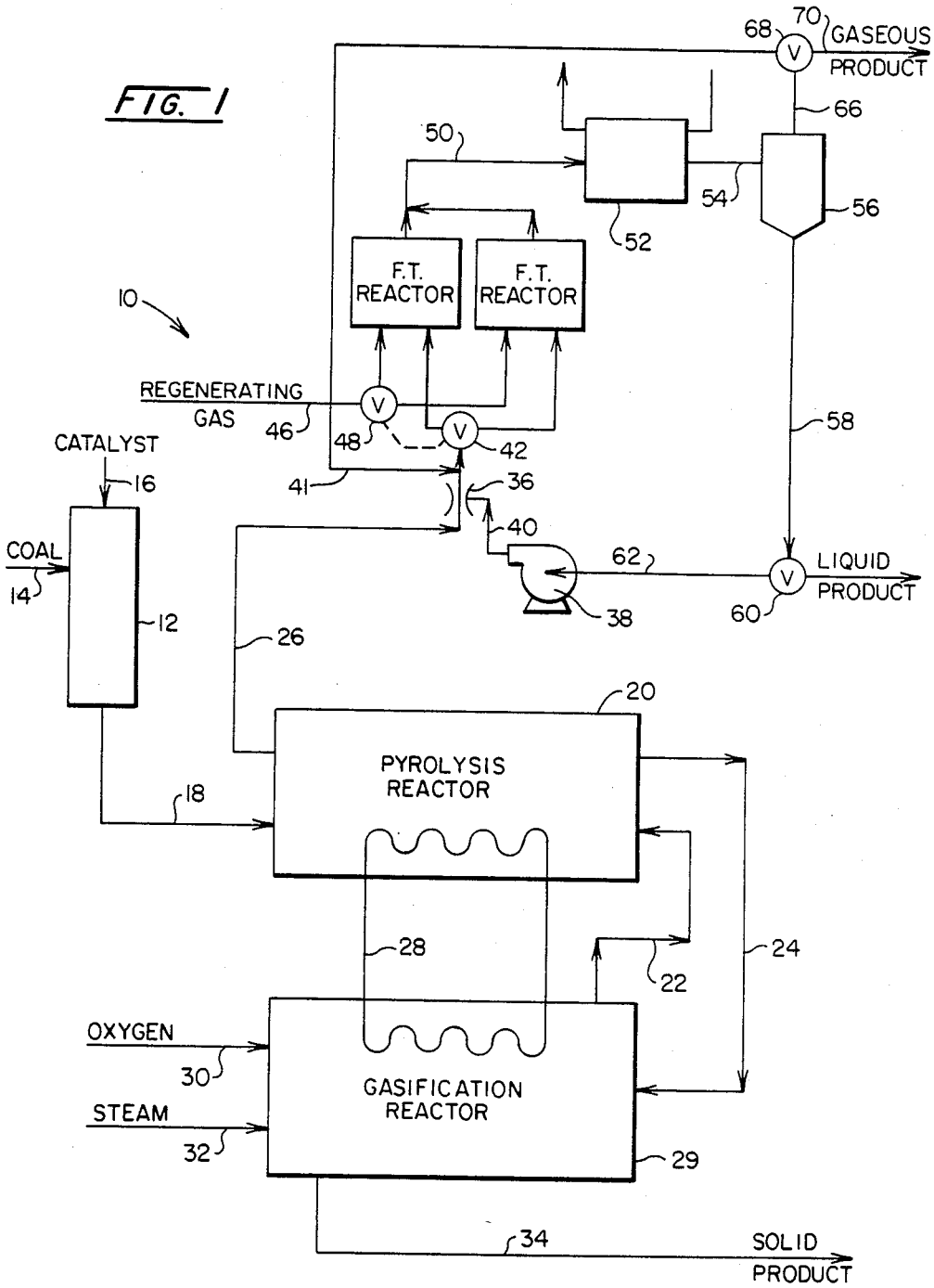
FIG. 1 is a flow diagram of an apparatus of the invention.

As already mentioned, the instant invention uses a process whereby a combination of a pyrolysis reaction and a gasification reaction is used to convert coal to gas, liquid and solid products. The gasification reaction generates a hydrogen-containing gas which, when passed over the coal during the pyrolysis reaction, tends to increase the yield of pyrolysis products to the desired range of molecular weights. Furthermore, the presence of the hydrogen-containing gas during the pyrolysis reaction tends to produce a greater proportion of hydrocarbons in the products of the pyrolysis reaction, thereby improving the yield of hydrocarbons and other organic compounds in the gas and liquid products of the process.

In the instant invention, the pyrolysis reaction is preferably effected at a temperature of about 399° to about 427° C. (750°–800° F.), since the use of higher temperatures tends to decrease the yield of gaseous and solid products from the pyrolysis reaction. As those skilled in the art are aware, a number of catalysts are known which improve the conversion of coal to liquids and gases in a pyrolysis reaction; such catalysts include sodium hydroxide, manganates and organic nitrogeneous bases such as pyridine. Desirably, the pyrolysis reaction in the instant method is catalyzed by one of these conventional catalysts. The catalyst is conveniently mixed, in solid or liquid form, with the coal before the coal enters the pyrolysis reaction.

One important advantage of the instant process is that the gasification of the solid residue from the pyrolysis reaction is conducted in an exothermic manner and the heat generated in the gasification reactor can thus be used to supply the heat necessary for pyrolysis. Accordingly, in the instant method and apparatus very desirably heat exchange is effected between the gasification reaction and the pyrolysis reaction so that the gasification reaction supplies at least part of, or usually all of, the heat needed for the pyrolysis reaction. Desirably, the gasification reaction is conducted at a temperature of about 593° to about 871° C.

As already mentioned, the instant pyrolysis reaction produces a solid residue and a gaseous fraction. This gaseous fraction needs to be cooled to produce the final gaseous and liquid products. The gaseous fraction leaving the pyrolysis reaction should of course be cooled to a temperature which will condense substantially all of the liquid product contained therein, so that the final gas product will not be contaminated by liquifiable materials which might cause difficulty by e.g. condensing in pipes through which the gas product is passed. Generally speaking, cooling the gaseous fraction to a temperature below about 65° C. will suffice to remove all the liquid product therefrom.

In the instant process, very desirably the gaseous fraction is subjected to a Fischer-Tropsch reaction before being cooled. As is well-known to those skilled in the art, commercial Fischer-Tropsch reactors operate most efficiently at a temperature of not in excess of about 205° C., whereas in the instant process the gaseous fraction having the pyrolysis reactor will usually be at a temperature of around 400° C. Also, a great amount of heat is generated by the Fischer-Tropsch reaction. Accordingly, to ensure proper operation of the Fischer-Tropsch reaction, it is necessary to cool the gaseous fraction leaving the pyrolysis reaction and such cooling is conveniently effected by recycling part of the liquid product produced by cooling in the cooling means and mixing this recycled liquid product with the gaseous fraction before the gaseous fraction enters the Fischer-Tropsch reaction so that the recycled part of the liquid product can serve to cool gaseous fraction to the proper temperature for the Fischer-Tropsch reaction. Further, the heat generated in the Fischer-Tropsch reaction is earned out of the Fischer-Tropsch reactor in the liquid stream. This heat is then removed in the heat exchanger. Obviously, in order that the gaseous fraction entering the Fischer-Tropsch reaction will be at a uniform temperature, the recycled liquid product should be thoroughly dispersed in the gaseous fraction. A variety of methods may be employed for effecting such dispersion; for example, the recycled liquid product could be sprayed under pressure from a liquid pump into the gaseous fraction. However, to simplify the apparatus necessary and to reduce the number of moving parts, it is preferred to disperse the liquid product in the gaseous fraction by passing the gaseous fraction through a venturi tube and passing the recycled liquid product through a conduit intersecting this venturi, so that the action of the venturi itself disperses the liquid product in the gaseous fraction. It is also preferred that part of the gaseous product from the cooling means be recycled and mixed with the gaseous fraction before the gaseous fraction enters the Fisher-Tropsch reaction in order to assist in cooling the gaseous fraction to the proper temperature for the Fischer-Tropsch reaction, as well as to permit greater conversion to liquid products.

As already mentioned, to carry out the instant coal conversion process in the most economical manner, it is desirable that the heat generated in the gasification reaction by used to supply heat to the pyrolysis reaction. To achieve this heat exchange, it is preferred that the pyrolysis reactor and the gasification reactor of the instant apparatus comprise parts of a single vessel, the pyrolysis reactor being disposed in the upper part of the vessel and the gasification reactor in the lower part, the pyrolysis reactor being divided from the gasification reactor by a transverse wall extending across the vessel. In this case, the conduit means of the instant apparatus can simply comprise walls defining at least one aperture passing through the transverse wall. Furthermore, to ensure efficient heat transfer from the gasification reactor to the pyrolysis reactor, this transverse wall is preferably made of a heat-conductive material, thereby permitting heat to pass from the gasification reactor to the pyrolysis reactor through the transverse wall, and the pyrolysis reactor may comprise transport means for moving coal along the transverse wall, thereby permitting pyrolysis of the coal by heat passing through the transverse wall. A particularly preferred form of the instant apparatus using such a heat-conducting transverse wall and transport means is described below with reference to FIG. 2.

The instant process has the important advantage of flexibility in that the relative proportions of gas, liquid and solid products produced can be varied over a considerable range. The ratio of gas to solid products produced in the gasification reaction can be varied by controlling the quantities of oxygen and steam injected into the gasification reaction; the greater the quantities of oxygen and steam injected, the more hydrogen-containing gas which will be produced and the smaller the proportion of the materials entering the gasifiction reactor having entered the gasification reactor ending as solid product. If the amount of hydrogen-containing gas passed from the gasification reaction to the pyrolysis reaction is increased, the composition of the gaseous fraction leaving the pyrolysis reaction will be shifted so as to include more hydrogen and more hydrocarbons, with consequent changes in the composition of both the final gas and liquid products. Accordingly, it will be seen that the method and apparatus of this invention provide a flexible process for producing gas, liquid and solid products from coal.

The preferred apparatus of the invention, generally designated 10 in FIG. 1, comprises a coal preparation unit 12, which is provided with a coal inlet 14 and a catalyst inlet 16. In the coal preparation unit 12, the coal is prepared for the pyrolysis reaction by size reduction, (optional) incorporation of catalyst therein and (optionally) pre-heating. The catalyst fed to the coal preparation unit 12 may be any of the catalysts known to improve the conversion of coal to liquids and gases, and may be for example, sodium hydroxide, a manganate or a basic nitrogeneous hydrocarbon such as pyridine. In as much as the operations performed in the coal preparation unit 12 are identical to those performed in similar coal preparation units of prior art processes for the pyrolysis of coal, it is believed that the operation of the coal preparation unit 12 will readily by apparent to those skilled in the art and that no further description thereof is necessary.

From the coal preparation unit 12, the coal, mixed with catalyst, is fed by a conduit 18 to a pyrolysis reactor 20. As will be apparent to those skilled in the art, the conduit 18 may be provided with flow control valves or similar devices to permit the coal to enter the pyrolysis unit 20 without allowing excessive escape of gas from the pyrolysis unit. In addition to a coal inlet connected to the conduit 18, the pyrolysis unit 20 has a gas inlet connected to a conduit 22; this conduit 22 supplies to the pyrolysis unit 20 a hydrogen-containing gas generated in a manner described below. The pyrolysis unit 20 is also provided with a solid residue outlet connected to a conduit 24 through which a solid residue leaves the pyrolysis reactor, and with a gas outlet connected to a gas conduit 26. The pyrolysis unit 20 is supplied with heat via a heat exchange means 28, which may in principle be a conventional heat exchanger, although as will be described below with reference to FIG. 2, the preferred form of the invention uses a different form of heat exchange means 28.

Within the pyrolysis reactor 20, the coal is heated to a temperature in excess of 260° C. (500° F.) and preferably in the range of 399° to 487° C. (750°–950° F.), the energy needed to heat the coal being supplied by the heat exchange means 28 and the hydrogen-containing gas entering the pyrolysis reactor 20 from the conduit 22, since, as will be explained below, the gas in the conduit 22 is at a temperature considerably in excess of 260° C. Subjecting the coal to the elevated temperature in the pyrolysis reactor converts the coal to a gaseous fraction, which leaves the pyrolysis reactor by the conduit 26, and a solid residue, which leaves the pyrolysis reactor via the conduit 24. It has been found that the passage of the hydrogen-containing gas from the conduit 22 over the coal undergoing pyrolysis in the pyrolysis reactor 20 reduces the tendency for the coal to cake and produces a better yield of hydrocarbons in the gas leaving the pyrolysis reactor through conduit 26. Normally, the gaseous fraction generated in the pyrolysis reactor comprises between 15 and 50% by weight of the coal entering the reactor, although the proportion of coal converted to the gaseous fraction varies greatly upon the type of coal used. The carbonaceous solid residue generated by pyrolysis is a carbonaceous solid residue similar to coke.

This carbonaceous solid residue leaving the pyrolysis reactor 20 via the conduit 24 passes to a gasification reactor 29 which is provided not only with a solid residue inlet connected to the conduit 24 but also with an oxygen inlet 30 through which is passed an oxygen-containing gas, usually air, and a steam inlet 32 through which is injected a stream of steam. The gasification reactor 29 also has a gas outlet connected to the conduit 22 and a solid product outlet connected to a conduit 34, through which the final solid product is discharged from the apparatus. Finally, the gasification reactor 29 supplies heat to the heat exchange means 28.

Within the gasification unit 29, the temperature is maintained above 482° C. (900° F.) and preferably within the range of 593° to 871° C. (1100°–1600° F.). At these elevated temperatures, reaction occurs between the carbonaceous solid residue from the pyrolysis reactor, oxygen and steam to produce a gas containing carbon monoxide, carbon dioxide, hydrogen, methane and other minor constituents. The temperature within the gasification unit and the proportion of the carbonaceous solid residue entering the gasification reactor 29 which is converted to gas therein can be controlled by varying the rate at which oxygen and steam are injected into the gasification reactor via the inlets 30 and 32 respectively. The temperature within the gasification reactor will of course affect the temperature of the gas passing from the gasification reactor to the pyrolysis reactor 20 via the conduit 22 and the rate of heat transfer via the heat exchange means 28, and will thus also control the temperature within the pyrolysis reactor 20. The solid product leaving the gasification reactor 29 via the conduit 34 can be used as a solid fuel, either alone or mixed with untreated coal, and makes a useful utility boiler fuel.

The gaseous fraction leaving the pyrolysis reactor 20 via the conduit 26 proceeds through a venturi gas eductor 36. A stream of recycled liquid product, generated in a manner described below, is pumped via a pump 38 through a conduit 40, which enters the gas eductor 36, where the recycled liquid product is finely dispersed in the gaseous fraction thereby cooling the gaseous fraction. Immediately downstream of the eductor 36, the gaseous fraction is also mixed with a stream of recycled gaseous product supplied via a conduit 41, this recycled gas product serving to further cool the gaseous fraction of the pyrolysis reactor and to permit further conversion of the gas to liquid products. The cooling of the gaseous product effected by the combined effect of the recycled streams of liquid and gas product causes a substantial proportion of the gaseous product to condense to liquid. This liquid serves as the heat transfer fluid for the Fischer-Tropsch reactor(s). Also, this liquid is subjected to further reducing conditions which alleviate polymer formation. It will be appreciated that, because of the elevated temperature within the pyrolysis reactor 20, all the material leaving this reactor via the conduit 26 is in gaseous form although much of the material would be in liquid form at ambient temperature.

The stream of mixed gas and liquid caused by mixing the recycled liquid and gas products with the gaseous fraction next enters a valve 42, which directs the stream of mixed gas and liquid to one of two Fischer-Tropsch reactors unnumbered. These Fischer-Tropsch reactors are operated in a manner which is conventional in the art and serve to react carbon monoxide and hydrogen present in the feed to produce carbon dioxide and hydrocarbons. The two Fischer-Tropsch reactors are operated in a conventional manner, one reactor receiving the gas/liquid material to be treated, while the other receives regenerating gas from a conduit 46 via a valve 48 (which is ganged for operation with the valve 42, as indicated by the broken line in FIG. 1), and thereafter the first reactor receiving the regenerating gas while the second reactor receives the gas/liquid mixture to be treated. As is well known to those skilled in the art, Fischer-Tropsch reactors operate most effectively at a temperature of 149° to 177° C. (300°–350° F.), and the recycled gas and liquid streams mixed with the gaseous fraction from the pyrolysis reactor are arranged to cool the gaseous fraction so that it enters the Fischer-Tropsch reactors at the correct temperature. These liquid streams remove the heat of reaction in the Fischer-Tropsch units. The Fischer-Tropsch reactors are preferably of the fixed-bed type, although fluidized bed or slurry reactors could also be used; those skilled in the art will appreciate that if slurry-type Fischer-Tropsch reactors are used, an associated sedimentation vessel or filter will be necessary to separate the catalyst for recycle to the Fischer-Tropsch reactors. Furthermore, in commercial practice it will normally be desirable to use more than two Fischer-Tropsch reactors with a majority of the reactors receiving the gaseous fraction to be treated at any one time, while a minority of the reactors are being regenerated.

The effluent from the Fischer-Tropsch reactors, passes via a conduit 50 to a heat exchanger 52, which may be of any convenient type, and which serves to cool the gas/liquid stream from the Fischer-Tropsch reactors to a temperature which will suffice to condense all the desired liquifiable products in the gas stream; normally, cooling the gas/liquid stream below about 65° C. will suffice. After cooling in the heat exchanger 52, the gas/liquid stream is passed via a conduit 54 to a gas-liquid separator 56. The liquid stream leaving the base of the gas-liquid separator 56 is passed via a conduit 58 to a valve 60, which divides the liquid stream into an output stream, which leaves the apparatus as liquid product via a conduit 62, and a recycle stream which is passed via a conduit 64 to the pump 38 and thence recycled as described above. Similarly, the gas stream from the gas liquid separator 56 is passed via a conduit 66 to a valve 68, which divides the gas stream into an output stream, which leaves the apparatus gas product via a conduit 70, and a recycle stream, which is recycled via the conduit 41, as described above.

It will be seen that the apparatus shown in FIG. 1 functions in an efficient and energy-conserving manner, since the hydrogen-containing gas and the heat necessary for carrying out the pyrolysis reaction in the pyrolysis reactor 20 are both supplied from the gasification reactor 29, so that no external source of heat or hydrogen-containing gas is necessary.

Figure 2:
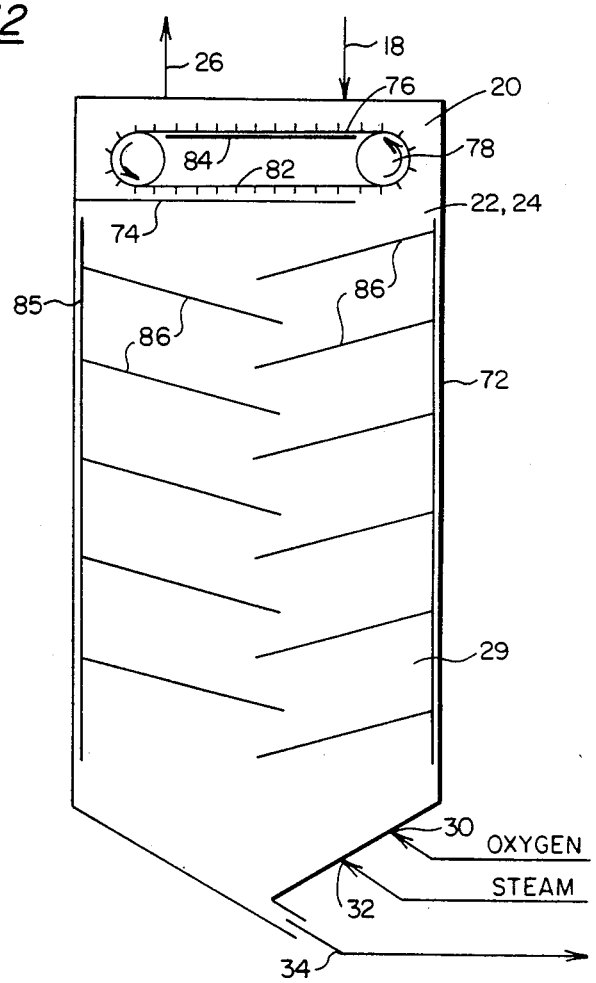
FIG. 2 shows a combined pyrolysis reactor and gasification reactor which can be used in the apparatus shown in FIG. 1.

FIG. 2 shows the presently preferred form of pyrolysis and gasification reactors for use in the apparatus shown in FIG. 1. In order to minimize the size of the apparatus, and to ensure efficient transfer of heat and hydrogen containing gas from the gasification reactor to the pyrolysis reactor, the pyrolysis and gasification reactors are combined in a single, substantially cubical vessel 72 (18–20 inches). The vessel 72 has an upper section which forms the pyrolysis reactor or chamber 20 and a lower section which forms the gasification reactor 29, the two reactors or chamber being divided from one another by a transverse, horizontally-extending, metal wall 74. An aperture is left between one edge of the metal wall and the vertical wall of the vessel 72, so that this aperture serves as the solid residue and gas conduits 24 and 22 respectively in FIG. 1. The coal conduit 18 and the gaseous fraction outlet conduit 26 are both disposed in the upper end wall of the vessel 72, while the solid product conduit 34, the oxygen inlet 30, and the steam inlet 32 are disposed along the gasification section of the apparatus.

The upper section of the vessel 72, which forms the pyrolysis reactor, has mounted therein an endless chain conveyor driven by rollers 78 so that the conveyor has horizontal upper and lower portions 76 and 82 respectively. The upper portion 76 of the conveyor runs across a support plate 84, while the lower portion 82 of the conveyor lies adjacent the transverse wall 74. Coal entering the vessel 72 via the conduit 18 falls onto the upper portion 76 of the conveyor, which carries the coal past the support plate 84, allowing the support plate 84 to preheat the coal. After passing along the support plate 84, the pre-heated coal passes around one of the rollers 78 and falls onto the transverse wall 74. Since this transverse wall 74 is made of metal, it efficiently conducts heat from the gasification reactor lying below it and attains a temperature sufficient to pyrolyze the coal. The lower portion 82 of the conveyor carries the coal along the wall 74, so that the coal is pyrolyzed in contact with this transverse wall. The pyrolysis time is of course dependent on the speed of the conveyor, generally, it has been found in the instant process that a pyrolysis time of about 15 minutes gives good results.

Eventually, the coal is carried by the conveyor over the end of the transverse wall 74 and falls through the aperture in the transverse wall 74 and the vessel 72 into the gasification reactor in the lower section of the vessel 72. Within the gasification reactor, a cylinder 85 is provided having a series of rotationally moving plates or baffles 86, which extend inwardly and downwardly from the walls of the cylinder 85 which is housed within vessel 72. Desirably, these plates or baffles are placed at an angle of about not more than 40° to the horizontal; generally an angle of about 10° to the horizontal gives good results. The solid residue formed from the coal pyrolyzed in the pyrolysis reactor is moved by the above mentioned rotationally moving plates or baffles through the gasification reactor. The above mentioned rotationally moving plates or baffles situate within the above mentioned cylinder function in such a manner as to mix the solid residue with the gases in a continuous and substantial manner, allowing the solid residue to be exposed to the oxygen and steam injected into the gasification reactor through inlets 30 and 32 respectively. Eventually, the particles of solid product formed by the action of oxygen and steam on the solid residue fall to the bottom of the vessel 72 and leave via the conduit 34; as those skilled in the art will appreciate, a water trap or some other sealing device is necessary to prevent excessive leakage of gas from the gasification unit via the conduit 34. The gaseous fraction formed in the pyrolysis reactor of course leaves the vessel 72 by the conduit 26 and is treated in the manner already described.

It will be apparent to those skilled in the art that numerous changes and modifications can be made in the preferred embodiments of the invention described above without departing from the scope of the invention. In particular, the eductor 36 in FIG. 1 might be replaced by a spray drum for mixing of the gaseous fraction of the pyrolysis reactor with the recycled liquid and gas, and the resultant gas and liquid stream pass to the Fischer-Tropsch reactors by a compressor and a pump respectively. However, in view of the temperatures involved, corrosion and other problems are likely to be encountered in such a compressor and thus we prefer to use the form of apparatus shown in FIG. 1 having a venturi eductor rather than a spray drum. In view of the aforementioned possible changes and modifications, the foregoing description is to be construed in an illustrative and not in a limitative sense, the scope of the invention being defined solely by the appended claims.

We claim:

1. Apparatus for the conversion of coal to gas, liquid and solid products, said apparatus comprising a single vessel including;

a pyrolysis chamber having an inlet for coal and an outlet for gas, said pyrolysis chamber being disposed in the upper part of said vessel;

a gasification chamber having an inlet for oxygen and steam and an outlet for a solid product, said gasification chamber being disposed in the lower part of said vessel;

means interconnecting said pyrolysis chamber and said gasification chamber comprising a common dividing wall extending substantially across the vessel, said wall having aperature means for delivering all solid residue generated in said pyrolysis chamber to said gasification chamber and for delivering all hot gases generated in said gasification chamber to said pyrolysis chamber, said common wall transferring heat from the gasification chamber to the pyrolysis chamber by conduction;

transport means in said pyrolysis chamber for moving coal along said common wall to said aperture means;

at least one baffle in said gasification chamber extending inwardly and downwardly from an inner wall of said vessel such that the solid residue from the pyrolysis chamber passing through said aperture means to the gasification chamber will contact said baffle;

means for removing gas leaving said gas outlet of said pyrolysis chamber and delivering said removed gas to a location separated from said pyrolysis chamber, and means for cooling gas delivered to said location to condense some of said gas while leaving some of said gas in gaseous form.

2. Apparatus according to claim 1 wherein said baffle makes an angle of not more than about 40° with the horizontal.

3. Apparatus according to claim 2 where a Fischer-Tropsch reactor is connected between said gas outlet of said pyrolysis chamber and said location.

4. Apparatus according to claim 3 wherein an auxiliary cooling means is disposed between said gas outlet of said pyrolysis chamber and said Fischer-Tropsch reactor.

5. Apparatus according to claim 4 wherein said auxiliary cooling means comprises means for recirculating part of the condensed product produced at said location and means for dispersing said recirculated part of said condensed product in gas passing through said auxiliary cooling means.

6. Apparatus according to claim 5 wherein said auxiliary cooling means comprises walls forming a venturi passage through which said gas passing from said pyrolysis chamber to said Fischer-Tropsch reactor must flow, and walls defining a conduit through which said recirculated part of said condensed product flows, said conduit intersecting said venturi passage at a position such that said condensed product will be dispersed in said gas.

7. Apparatus according to claim 3 further comprising means for recirculating part of the gas product produced at said location to said Fischer-Tropsch reactor.

8. Apparatus according to claim 1 where a Fischer-Tropsch reactor is connected between said gas outlet of said pyrolysis chamber and said location.

* * * * *